US008785357B2

(12) United States Patent
Mosier et al.

(10) Patent No.: US 8,785,357 B2
(45) Date of Patent: Jul. 22, 2014

(54) COMPOSITION CONTAINING HETEROCYCLIC COMPOUNDS AND A METHOD OF LUBRICATING AN INTERNAL COMBUSTION ENGINE

(75) Inventors: Patrick E. Mosier, Bay Village, OH (US); Jason R. Brown, Chester (GB); Matthew D. Gieselman, Wickliffe, OH (US); Calvin W. Schroeck, Willoughby Hills, OH (US); Seth Crawley, Mentor, OH (US); William Barton, Belper (GB); William C. Ward, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 166 days.

(21) Appl. No.: 13/060,492

(22) PCT Filed: Sep. 14, 2009

(86) PCT No.: PCT/US2009/056784

§ 371 (c)(1),
(2), (4) Date: Apr. 26, 2011

(87) PCT Pub. No.: WO2010/033447

PCT Pub. Date: Mar. 25, 2010

(65) Prior Publication Data

US 2011/0190180 A1 Aug. 4, 2011

Related U.S. Application Data

(60) Provisional application No. 61/097,376, filed on Sep. 16, 2008.

(51) Int. Cl.

| | |
|---|---|
| ***C10L 1/22*** | (2006.01) |
| ***C10M 159/18*** | (2006.01) |
| ***C10M 169/04*** | (2006.01) |
| ***C10M 129/20*** | (2006.01) |
| ***C10M 133/46*** | (2006.01) |
| ***C10M 159/12*** | (2006.01) |
| ***C10M 133/44*** | (2006.01) |
| ***C10M 133/48*** | (2006.01) |
| ***C10M 133/40*** | (2006.01) |
| ***C10M 133/58*** | (2006.01) |

(52) U.S. Cl.

CPC ..... *C10M 133/40* (2013.01); *C10M 129/20* (2013.01); *C10M 2219/046* (2013.01); *C10N 2230/52* (2013.01); *C10M 2215/223* (2013.01); *C10M 133/46* (2013.01); *C10M 159/12* (2013.01); *C10M 2215/064* (2013.01); *C10M 2205/022* (2013.01); *C10M 133/44* (2013.01); *C10M 2215/225* (2013.01); *C10N 2240/101* (2013.01); *C10M 2215/221* (2013.01); *C10M 2215/224* (2013.01); *C10M 133/48* (2013.01); *C10N 2230/42* (2013.01); *C10N 2230/06* (2013.01); *C10M 2205/04* (2013.01); *C10M 2215/28* (2013.01); *C10N 2240/103* (2013.01); *C10N 2240/105* (2013.01); *C10M 2207/028* (2013.01); *C10M 2207/262* (2013.01); *C10M 133/58* (2013.01); *C10N 2220/033* (2013.01); *C10N 2240/102* (2013.01); *C10M 2207/044* (2013.01); *C10M 2223/045* (2013.01); *C10N 2240/104* (2013.01)

USPC ..... 508/304; 508/243; 508/267

(58) Field of Classification Search

CPC . C10M 105/22; C10M 129/20; C10M 129/26

USPC ..... 508/309, 304, 243

See application file for complete search history.

(56) References Cited

U.S. PATENT DOCUMENTS

| | | | | |
|---|---|---|---|---|
| 2,113,754 | A | 4/1938 | Zimmer et al. | |
| 3,629,114 | A * | 12/1971 | Fairing | 508/440 |
| 4,113,725 | A | 9/1978 | Nnadi et al. | |
| 4,157,972 | A | 6/1979 | Hotten | |
| 4,169,801 | A | 10/1979 | Schlicht | |
| 4,196,091 | A | 4/1980 | Schlicht | |
| 4,225,712 | A | 9/1980 | Hotten | |
| 4,228,282 | A | 10/1980 | Hotten | |
| 4,358,387 | A | 11/1982 | Zoleski et al. | |
| 4,386,001 | A | 5/1983 | Zoleski et al. | |
| 4,840,741 | A | 6/1989 | Beltzer et al. | |
| 5,034,143 | A | 7/1991 | O'Lenik | |
| 5,880,072 | A | 3/1999 | Furey et al. | |
| 7,098,173 | B2 * | 8/2006 | Calcut et al. | 508/582 |
| 2006/0217273 | A1 | 9/2006 | Ozbalik et al. | |

FOREIGN PATENT DOCUMENTS

| | | |
|---|---|---|
| EP | 0294060 | 12/1988 |
| EP | 1451276 | 9/2004 |
| EP | 2011853 | 1/2009 |
| GB | 1399345 | 7/1975 |

(Continued)

OTHER PUBLICATIONS

Corresponding PCT Publication No. 2010/033447 A2 published Mar. 25, 2010.

(Continued)

*Primary Examiner* — Prem C Singh
*Assistant Examiner* — Francis C Campanell
(74) *Attorney, Agent, or Firm* — Michael F. Esposito, Esq.; David M. Shold, Esq.

(57) ABSTRACT

The present Invention relates to the use of a compound in a lubricating composition as an engine oil antiwear and/or extreme pressure agent, wherein the compound is a heterocycle having a hydrocarbyl group containing 6 to 40 carbon atoms, wherein the heterocycle is either (i) a heterocycle compound having a functional group selected from the group consisting of at least one of an ester, an amide, a salt and an acid, or (ii) a pyrimidine.

3 Claims, No Drawings

(56) References Cited

FOREIGN PATENT DOCUMENTS

| | | |
|---|---|---|
| JP | 02049096 | 2/1990 |
| SU | 1068466 | 1/1984 |
| WO | 2007119400 | 10/2007 |

OTHER PUBLICATIONS

Ren, T., et al., "The Effect of Molecular Structure of N-containing Heterocyclic Compounds on Their Wear Properties", Lubrication Science, Leaf Coppin Publishing Ltd., US, vol. 5, No. 3, pp. 205-212, Apr. 1, 1993.

Wei, D., et al., "The Wear Behaviour of Steel Lubricated by Some Oxygen-Containing Derivatives of Heterocyclic Nitrogen-containing Compounds . . . ," Lubrication Science, Leaf Coppin Publishing Ltd., US, vol. 4, No. 3, pp. 219-232, Jan. 1, 1992.

He, Z., et al., The Tribiochemical Study of Some N-containing Heterocyclic Compounds as Lubricating Oil Additives, Tribology Letters, Baltzer Science Publishers, NL, vol. 13, No. 2, pp. 87-93, Jan. 1, 2002.

Abstract of Japanese Patent No. 02049096, Feb. 19, 1990, Patent Abstracts of Japan.

Written Opinion of corresponding international application No. PCT/US2009/056784 dated Jul. 8, 2010.

* cited by examiner

COMPOSITION CONTAINING HETEROCYCLIC COMPOUNDS AND A METHOD OF LUBRICATING AN INTERNAL COMBUSTION ENGINE

FIELD OF INVENTION

The invention provides a lubricating composition containing a heterocyclic compound. The invention further relates to a method of lubricating an internal combustion engine by lubricating the engine with the lubricating composition. The invention further relates to the use of the heterocyclic compounds as antiwear and/or extreme pressure agents.

BACKGROUND OF THE INVENTION

Engine manufacturers have focused on improving engine design in order to improve fuel economy and efficiency (typically, based on Federal Corporate Average Fuel Economy (CAFE) standards) and reduce wear. Whilst improvements in engine design and operation have contributed, improved formulation of engine oil lubricant may also reduce wear whilst improving fuel economy and efficiency. They also serve to reduce the friction between sliding moving parts (typically metallic or ceramic) that are in contact.

It is well known for lubricating oils to contain a number of additives (including antiwear agents, antioxidants, dispersants, or detergents) used to protect internal combustion engines from wear, oxidation, soot deposits and acid build up. A common antiwear additive for engine lubricating oils is zinc dialkyldithiophosphate (ZDDP). It is believed that ZDDP antiwear additives protect the engine by forming a protective film on metal surfaces. ZDDP may have a detrimental impact on fuel economy and efficiency. Consequently, engine lubricants may also contain a friction modifier to obviate any detrimental impact of ZDDP on fuel economy and efficiency. Both ZDDP and friction modifier function by adsorption on sliding surfaces, and each may interfere with each other's respective functions.

Further, engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

With increasing control of emissions (typically to reduce $NO_x$ formation, $SO_x$ formation, formation of sulphated ash) there is a desire towards reduced amounts of sulphur, phosphorus and sulphated ash in engine oils. The phosphorus from ZDDP is also believed to be relatively volatile and with the coming introduction of the GF-5 specification, tighter limits on emissions of phosphorus may be required. However, reducing the levels of antiwear additives such as ZDDP is likely to increase wear and result in other detrimental performance of an engine.

In addition, as technology develops, components of an engine are exposed to more severe operating conditions. Operating conditions may include higher power density engines, use of turbo chargers, use of alternative fuels and the like. Under many severe operating conditions, wear and/or oxidation of lubricant and components occurs more readily.

U.S. Pat. No. 4,840,741 discloses antiwear additives derived from pyridines, pyrimidines, pryazines, pyridazines and/or fused derivatives thereof. The antiwear agents are also functionalised with at least one member of the group consisting of halogens, chloromethyl, dichloromethyl, trichloro-methyl, chlorobromomethyl, bromomethyl, dibromomethyl, cyano, isocyano, methylcyano, cyanomethyl, cyanate, isocyanate, thiocyanate, isothiocyanate, nitro, nitromethyl, nitroso, formyl, acetyl, methyl carboxylate, methoxy, methylthio, thiol, and disulphide.

SU 1068466 discloses lubricating oils with good anti-seize and antiwear properties contains 1-4 weight percent of a salt of 1-(2-aminoethyl)-2-imidazolidinone with a di-$C_{8-10}$-alkyl dithio phosphate.

SUMMARY OF THE INVENTION

The inventors of the this invention have discovered that a lubricating composition and method as disclosed herein is capable of providing acceptable levels of at least one of (i) phosphorus emissions (typically reducing or preventing emissions), (ii) sulphur emissions (typically reducing or preventing emissions), and (iii) wear and/or extreme pressure performance (typically reducing or preventing wear).

In one embodiment the invention provides lubricating composition comprising an oil of lubricating viscosity and a heterocycle having a hydrocarbyl group containing 6 to 40 carbon atoms, wherein the heterocycle is either:

(b1) a heterocycle compound having a functional group selected from the group consisting of at least one of an ester, an amide, a salt and an acid, or (b2) a pyrimidine (that is, not necessarily having a functional group as described in (b1)).

In one embodiment the invention provides a lubricating composition comprising an oil of lubricating viscosity and a heterocycle having a hydrocarbyl group containing 6 to 40 (or 6 to 20, or 8 to 18) carbon atoms wherein the heterocycle is selected from the group consisting of:

(i) an ester-containing heterocycle;

(ii) an amide-containing heterocycle; and (iii) a pyrimidine (that is, not necessarily having a functional group as described in (b1)).

In one embodiment the hydrocarbyl group containing 6 to 40 carbon atoms may be a linear or branched alkyl group.

In one embodiment the compound may be present at 0.01 wt % to 10 wt %, or 0.2 to 5 wt % of the lubricating composition.

In one embodiment invention provides for the use of the compound as described herein as an antiwear and/or extreme pressure agent.

In one embodiment the invention provides for the use of the compound disclosed herein as an engine oil antiwear and/or extreme pressure agent.

In one embodiment, the engine contains an aluminium alloy component.

In one embodiment the lubricating composition may be further characterised as having at least one of (i) a sulphur content of 0.8 wt % or less, (ii) a phosphorus content of 0.2 wt % or less, or (iii) a sulphated ash content of 2 wt % or less.

In one embodiment the lubricating composition may be further characterised as having (i) a sulphur content of 0.5 wt % or less, (ii) a phosphorus content of 0.1 wt % or less, and (iii) a sulphated ash content of 1.5 wt % or less.

In one embodiment the lubricating composition further includes at least one of a friction modifier, a viscosity modifier, an antioxidant, an over-based detergent, a succinimide dispersant, or mixtures thereof.

In one embodiment the lubricating composition further includes a viscosity modifier and an overbased detergent.

In one embodiment the lubricating composition further includes an overbased detergent and a succinimide dispersant.

In one embodiment the invention provides a method for lubricating an engine comprising supplying to the engine a lubricating composition as disclosed herein.

DETAILED DESCRIPTION OF THE INVENTION

The present invention provides a lubricating composition and a method for lubricating a mechanical device as disclosed above. Typically the mechanical device may be an internal combustion engine.

The Heterocycle

The heterocycle may be a pyrrole, a pyrrolidine, a pyrrolidinone, a pyridine, a piperidine, a pyrone, a pyrazole, a pyrazine, pyridazine, a 1,2-diazole, a 1,3-diazole, a 1,2,4-triazole, a benzotriazole, a quinoline, an indole, an imidazole, an oxazole, an oxazoline, a thiazole, a thiophene, an indolizine, a pyrimidine, a triazine, a furan, a tetrahydrofuran, a dihydrofuran, or mixtures thereof. In one embodiment the heterocycle (or the ester-containing heterocycle or the amide-containing heterocycle) may be a furan or a tetrahydrofuran.

In one embodiment the heterocycle has a ring containing nitrogen or oxygen.

In one embodiment the heterocycle (or the ester-containing heterocycle or the amide-containing heterocycle) may be a pyrrole, a pyrrolidine, a pyrrolidinone, a pyridine, a piperidine, a pyrone, a pyrimidine, an oxazoline, a triazine, or mixtures thereof. In one embodiment the heterocycle (or the ester-containing heterocycle or the amide-containing heterocycle) may be a pyrrole, or a pyrrolidine.

Without being bound by theory, it is believed that the heterocycle (including the pyrimidine compounds of the invention) is capable of forming a 5-membered or 6-membered chelate with a surface (typically a metal (including both ferric and aluminium) based surface) of the engine. The chelate formed is then believed to produce a surface coating that helps with providing antiwear and/or extreme pressure performance.

The heterocycle as described herein may be aromatic or not aromatic.

In one embodiment the heterocycle (or the ester-containing heterocycle or the amide-containing heterocycle) is not an aromatic compound.

When not aromatic, the heterocycle (or the ester-containing heterocycle or the amide-containing heterocycle) may be represented by the formulae:

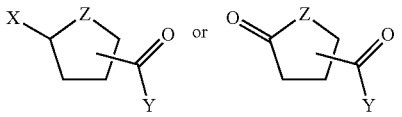

wherein, independently, each variable

Z may be —O—, or >NH, or >$NR^1$, or >$NR^2$, or >$NR^{12}$;

$R^1$ may be an ester group of formula -Ak'-O—C(O)$R^3$, wherein the Ak' group may be alkylene containing 2 to 6, or 2 to 3 carbon atoms;

$R^2$ may be an alkyl group containing 1 to 6, or 2 to 3 carbon atoms;

$R^3$ may be a hydrocarbyl group (typically linear or branched alkyl) containing 1 to 40 carbon atoms (typically a linear or branched alkyl or alkenyl group of 4 to 20 carbon atoms, or a hindered phenol);

Y may be —O—$R^4$, or —$NHR^4$, or —$N(R^4)_2$, —O—$R^{11}$, or —$NHR^{11}$, or —$N(R^{11})_2$, —OH, an oxygen anion (in conjunction with an amine cation or a metal cation) (or typically —O—$R^4$, or —$NHR^4$, or —$N(R^4)_2$, or most typically —O—$R^4$, or —$NHR^4$);

$R^4$ may be a hydrocarbyl group (typically linear or branched alkyl) containing 6 to 40 carbon atoms;

$R^{11}$ may be a hydrocarbyl group (typically linear or branched alkyl) containing 1 to 40, or 2 to 20 carbon atoms, or a hydroxy alkyl group (typically containing 1 to 10, or 1 to 5 carbon atoms, such as hydroxyethyl or hydroxypropyl);

$R^{12}$ may be a hydrocarbyl group (typically linear or branched alkyl) containing 1 to 40 carbon atoms (typically a linear or branched alkyl or alkenyl group of 4 to 20 carbon atoms), and X may be hydrogen, —C(O)Y, an alkyl group containing 1 to 30 carbon atoms, or an adjoining aromatic or heterocyclic ring.

In one embodiment the heterocycle (or the ester-containing heterocycle or the amide-containing heterocycle) may be represented by the formulae:

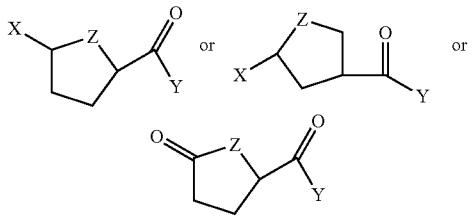

wherein each variable is described above.

When Z may be >$NR^1$, and $R^1$ may be the ester group of formula -Ak'-O—C(O)$R^3$, and $R^3$ may be a hindered phenol group, the -Ak'-O—C(O)$R^3$ group may be represented by the formula:

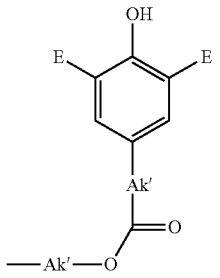

wherein, independently, each variable

Ak' may be an alkylene group containing 2 to 6, or 2 to 3 carbon atoms; and

E may be a sterically hindering group, that is, a sterically bulky group (typically secondary or tertiary butyl, usually a tertiary butyl group).

Examples of a hydrocarbyl group (typically linear or branched alkyl) of $R^4$ include octyl, 2-ethylhexyl, decyl, undecyl, dodecyl, tridecyl, iso-tridecyl, tetradecyl, pentadecyl, hexadecyl, heptadecyl, octadecyl, nonadecyl, eicosyl, oleyl, or mixtures thereof.

In one embodiment the heterocycle (or the ester-containing heterocycle or the amide-containing heterocycle) may be represented by the formulae:

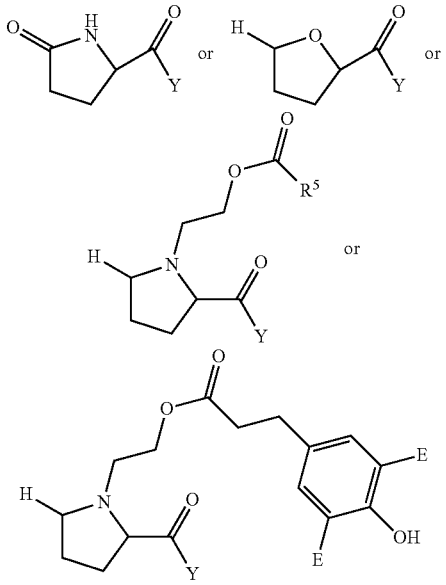

wherein, independently, each variable $R^5$ may be an alkyl group containing 1 to 4 carbon atoms;

Y may be —O—$R^4$, or —$NHR^4$, or —$N(R^4)_2$ (or typically —O—$R^4$, or —$NHR^4$);

$R^4$ may be a hydrocarbyl group (typically linear or branched alkyl) containing 6 to 40 carbon atoms; and E may be a sterically hindering group (typically secondary or tertiary butyl, usually a tertiary butyl group).

In one embodiment the heterocycle compound having a functional group selected from the group consisting of at least one of an ester, an amide, a salt and an acid of formula:

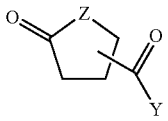

may be described as a compound of the formula

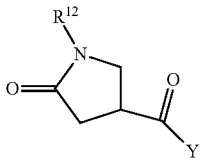

wherein, independently, each variable $R^{12}$ may be a hydrocarbyl group (typically linear or branched alkyl) containing 1 to 40 carbon atoms (typically a linear or branched alkyl or alkenyl group of 4 to 20 carbon atoms), and Y may be —O—$R^{11}$, or —$NHR^{11}$, or —$N(R^{11})_2$, —OH, an oxygen anion (in conjunction with an amine cation or a metal cation present in an amount sufficient to satisfy the valence of Y); and $R^{11}$ may be a hydrocarbyl group (typically linear or branched alkyl) containing 1 to 40, or 2 to 20 carbon atoms, or a hydroxy alkyl group.

The metal cation includes lithium, potassium, sodium, calcium, magnesium, zinc, copper, or mixtures thereof.

In one embodiment the heterocycle (or the ester-containing heterocycle or the amide-containing heterocycle) may be an aromatic compound.

In one embodiment the heterocycle (or the ester-containing heterocycle or the amide-containing heterocycle) may be an aromatic compound represented by the formulae:

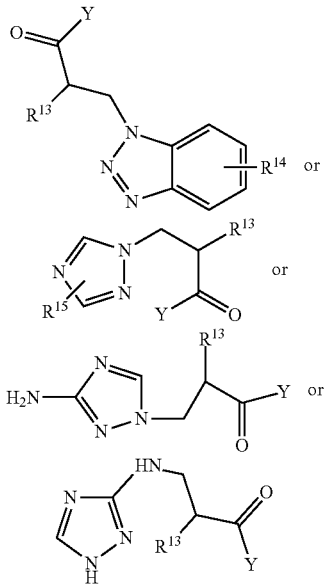

wherein

Y may be —O—$R^4$, or —$NHR^4$, or —$N(R^4)_2$ (or typically —O—$R^4$, or —$NHR^4$);

$R^4$ may be a hydrocarbyl group (typically linear or branched alkyl) containing 6 to 40 carbon atoms;

$R^{13}$ may be an ester, nitrile, ketone, acid, amide, or aldehyde;

$R^{14}$ may be an alkyl group containing 1 to 20, or 1 to 10, or 1 to 4 carbon atoms (typically methyl); and $R^{15}$ may be hydrogen or an alkyl group containing 1 to 4 carbon atoms (typically hydrogen).

The triazole compounds above may be derived from a 1,2,4-triazole, a benzotriazole (such as tolyltriazole), 3-amino-1,2,4-triazole, or mixtures thereof.

In one embodiment the heterocycle (or the ester-containing heterocycle or the amide-containing heterocycle) may be an aromatic compound represented by the formula:

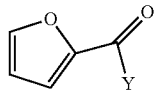

wherein, independently, each variable

Y may be —O—$R^4$, or —$NHR^4$, or —$N(R^4)_2$ (or typically —O—$R^4$, or —$NHR^4$); and $R^4$ may be a hydrocarbyl group (typically linear or branched alkyl) containing 6 to 40 carbon atoms.

In one embodiment the heterocycle (or the ester-containing heterocycle or the amide-containing heterocycle) may be an aromatic compound represented by the formula:

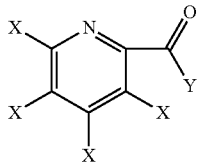

wherein, independently, each variable

Y may be —O—$R^4$, or —$NHR^4$, or —$N(R^4)_2$ (or typically —O—$R^4$, or —$NHR^4$);

$R^4$ may be a hydrocarbyl group (typically linear or branched alkyl) containing 6 to 40 carbon atoms; and X may be hydrogen, —C(O)Y, an alkyl group containing 1 to 30 carbon atoms, or an adjoining aromatic or heterocyclic ring.

In one embodiment the heterocycle may be an aromatic compound represented by the formula:

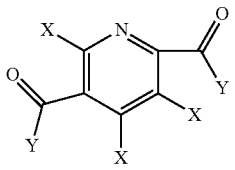

wherein, independently, each variable

Y may be —O—$R^4$, or —$NHR^4$, or —$N(R^4)_2$ (or typically —O—$R^4$, or —$NHR^4$);

$R^4$ may be a hydrocarbyl group (typically linear or branched alkyl) containing 6 to 40 carbon atoms; and X may be —C(O)Y, an alkyl group containing 1 to 30 carbon atoms, or an adjoining aromatic or heterocyclic ring, or hydrogen (and X may be typically hydrogen).

In one embodiment the heterocycle (or the ester-containing heterocycle or the amide-containing heterocycle) may be an aromatic compound represented by the formula:

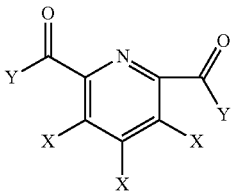

wherein, independently, each variable

Y may be —O—$R^4$, or —$NHR^4$, or —$N(R^4)_2$ (or typically —O—$R^4$, or —$NHR^4$);

$R^4$ may be a hydrocarbyl group (typically linear or branched alkyl) containing 6 to 40 carbon atoms; and X may be —C(O)Y, an alkyl group containing 1 to 30 carbon atoms, or an adjoining aromatic or heterocyclic ring, or hydrogen (and X may be typically hydrogen).

In one embodiment the heterocycle (or the ester-containing heterocycle or the amide-containing heterocycle) may be an aromatic compound represented by the formula:

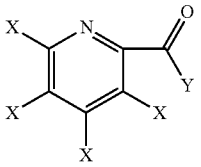

wherein, independently, each variable

Y may be —O—$R^4$, or —$NHR^4$, or —$N(R^4)_2$ (or typically —O—$R^4$, or —$NHR^4$);

$R^4$ may be a hydrocarbyl group (typically linear or branched alkyl) containing 6 to 40 carbon atoms; and X may be —C(O)Y, an alkyl group containing 1 to 30 carbon atoms, or an adjoining aromatic or heterocyclic ring, or hydrogen (and X may be typically hydrogen).

In one embodiment the pyrimidine may be an oxidized or reduced variant of the pyrimidine heterocycle, such as those represented by the formulas:

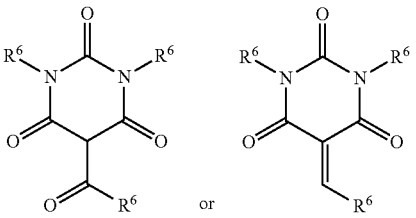

wherein, independently, each variable $R^6$ may be hydrogen or a hydrocarbyl group (typically linear or branched alkyl, or an alkaryl (such as dodecylphenyl or 3-heptylphenyl)) containing 3 to 40 carbon atoms, with the proviso that at least one $R^6$ contains 6 to 40 carbon atoms.

In one embodiment the heterocycle (or the ester-containing heterocycle or the amide-containing heterocycle) may be a non-aromatic compound represented by the formula (i.e., an oxazoline):

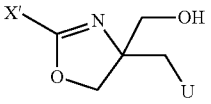

wherein, independently, each variable

U may be —OC(O)$R^4$, or —NH—C(O)—$R^4$, or —$NR^S$—C(O)—$R^4$, or —OH;

$R^4$ may be a hydrocarbyl group (typically linear or branched alkyl) containing 6 to 40 carbon atoms;

$R^5$ may be an alkyl group containing 1 to 4 carbon atoms; and

X' may be U, an alkyl or alkenyl group containing 1 to 30 carbon atoms, or an adjoining aromatic or heterocyclic ring, or hydrogen (and X' may be typically an alkyl or alkenyl group containing 1 to 30, or 6 to 20 carbon atoms), with the proviso that on any oxazoline molecule U and X' are not both —OH. When X' is —OH, the structure represented above may tautomerise to form a carbamate.

In one embodiment the oxazoline may be prepared from a reaction of a carboxylic acid (or a reactive equivalent thereof) with an amino alcohol or a polyamine, wherein the oxazoline contains at least two hydrocarbyl groups.

The oxazoline may be prepared from any of the following: isostearic acid/trishydroxymethylamino methane ("THAM")

(2:1 mole ratio); isostearic acid/2-amino-2-ethyl-1,3-propanediol, (2:1 mole ratio); Sarkosyl O™/Duomeen T™ (1:1 mole ratio), where Sarkosyl O is a commercial product made from oleic acid and sarcosine (N-methylglycine); octadecyl succinic anhydride/ethanol amine/isostearic acid (1:1:1 mole ratio); and any of the foregoing materials reacted with propylene oxide (in, e.g., a 1:1 mole ratio).

These materials are derived by the condensation of an acid (1) with an amine containing molecule (2). The general scheme may have molecules that may contain average two long chain alkyl groups to one central polar group.

The condensation product, of the carboxylic acids or equivalents (e.g., anhydrides, acid halides, esters) (1) may be as shown in the specific examples, or be a similar carboxylic acid derived from fatty acids from natural plant and animal oils or synthetically produced. They are, generally, in the 8 to 30 carbon atom range and are substantially linear in character. Examples are stearic acid, palmitic acid, oleic acid, tall oil acids, acids derived from the oxidation of hydrocarbons, substituted succinic acids, ether-acids derived from the addition of alcohols to acrylates or methacrylates.

The amine containing material (2) is, generally, an aminoalcohol or a polyamine such as a 1,3-diamine. The term "polyamine" is intended to encompass diamines as well as molecules containing three or more amino groups. However, at least two of the amino groups may contain a replaceable hydrogen, that is, there should be at least two primary or secondary amino groups. Examples of amino alcohols are tris-hydroxymethylaminomethane, 2-amino-2-ethyl-1,3-propanediol, and ethanol amine. Other amino alcohols are also anticipated to be of use in this condensation. The 1,3-diamines are of the general formula $R^7R^8$—N—$CH_2$—$CH_2$—$CH_2$—$NR^7R^8$ where $R^7$ and $R^8$ may be either H or hydrocarbyl independently, although, as stated above, in at least two of the amino groups, at least one of $R^7$ and $R^8$ may be H. Typical hydrocarbyl groups include $C_6$ to $C_{40}$ or $C_8$ to $C_{24}$ alkyl groups with substantially straight chain character.

In one embodiment the heterocycle (or the ester-containing heterocycle or the amide-containing heterocycle) may be a non-aromatic compound represented by the formula (i.e., an imidazoline):

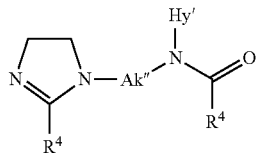

wherein, independently, each variable $R^4$ may be a hydrocarbyl group (typically linear or branched alkyl) containing 6 to 40 carbon atoms;

Ak'' may be an alkylene group containing 1 to 6, or 2 to 3, or 2 carbon atoms, optionally containing one or more nitrogen atoms (typically alkylene may be —$C_2H_4$—); and Hy' may be a hydrocarbyl group (typically linear or branched alkyl), or an alkyl group containing up to 40 carbon atoms, or a residue of a polyamine (typically ethylene polyamines).

The imidazoline heterocycle may be prepared from a condensation reaction of a fatty acid and a polyamine. In one embodiment the condensation products are hydrocarbyl imidazolines. In one embodiment the condensation product is a mixture of hydrocarbyl imidazolines and hydrocarbyl amides.

The fatty acid may be alkyl, cycloalkyl, or aryl (typically alkyl). In one embodiment the fatty acid contains 8 or more, 10 or more, or 14 or more carbon atoms (including the carbon of a carboxy group). The fatty acid may contain 8 to 30, or 12 to 24, or 16 to 18 carbon atoms.

Examples of suitable fatty acids may include caprylic acid, capric acid, lauric acid, myristic acid, palmitic acid, stearic acid, eicosanoic acid and, tall oil acids. In one embodiment the fatty acid is stearic acid.

When Hy' is the residue of a polyamine, the polyamine may be derived from alkylenepolyamines selected from the group consisting of ethylenepolyamines, propylenepolyamines, butylenepolyamines and mixtures thereof. Examples of propylenepolyamines may include propylenediamine and dipropylenetriamine. In one embodiment the polyamine may be an ethylenepolyamine are selected from the group consisting of ethylenediamine, diethylenetriamine, triethylenetetramine, tetraethylenepentamine, pentaethylenehexamine, N-(2-aminoethyl)-N'-[2-[(2-aminoethyl)amino]ethyl]-1,2-ethanediamine, polyamine still bottoms and mixtures thereof.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (typically hydrogenated) (e.g., polybutylenes, polypropylenes, propyleneisobutylene copolymers); poly(1-hexenes), poly(1-octenes), poly(1-decenes), and mixtures thereof; alkylbenzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity includes an API Group I, Group II, Group III, Group IV, Group V oil or mixtures thereof. Often the oil of lubricating viscosity is an API Group I, Group II, Group III, Group IV oil or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed hereinabove) is in the form of a concentrate (which may be combined with additional oil to form, in whole or in part, a finished lubricant), the ratio of the of these additives to the oil of lubricating viscosity and/or to diluent oil include the ranges of 1:99 to 99:1 by weight, or 10:90 to 80:20 by weight.

Other Performance Additives

The composition optionally includes other performance additives. The other performance additives comprise at least one of metal deactivators, viscosity modifiers, detergents, friction modifiers, antiwear agents (other than the compounds of the present invention), corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition of the invention further includes at least one of a friction modifier, a viscosity modifier, an antioxidant, an overbased detergent, a succinimide dispersant, or mixtures thereof.

In one embodiment the lubricating composition of the invention further includes at least one of a viscosity modifier, an antioxidant, an overbased detergent, a succinimide dispersant, or mixtures thereof.

Detergents

In one embodiment the lubricating composition further includes known neutral or overbased detergents. Suitable detergent substrates include phenates, sulphur containing phenates, sulphonates, salixarates, salicylates, carboxylic acids, phosphorus acids, mono- and/or di-thiophosphoric acids, alkyl phenols, sulphur coupled alkyl phenol compounds, or saligenins. Various overbased detergents and their methods of preparation are described in greater detail in numerous patent publications, including WO2004/096957 and references cited therein. The detergent substrate may be salted with a metal such as calcium, magnesium, potassium, sodium, or mixtures thereof.

In one embodiment the overbased detergent is selected from the group consisting of phenates, sulphur containing phenates, sulphonates, salixarates, salicylates, and mixtures thereof. Typically the selected overbased detergent include calcium or magnesium phenates, sulphur containing phenates, sulphonates, salixarates, saliginens, salicylates, or mixtures thereof.

In one embodiment the detergent may be a calcium salicylate. In another embodiment the detergent may be a calcium sulphonate. In another embodiment the invention the detergent may be a mixture of a calcium sulphonate and a calcium salicylate.

In one embodiment the detergent may be a calcium phenate. In another embodiment the detergent may be a calcium sulphonate. In another embodiment the invention the detergent may be a mixture of a calcium sulphonate and a calcium phenate.

When the lubricating composition is not lubricating a 2-stroke marine diesel engine the detergent or detergents may be present (on an oil free basis, i.e., an actives basis) at 0 wt % to 10 wt %, or 0.1 wt % to 8 wt %, or 1 wt % to 4 wt % of the lubricating composition. When the lubricating composition is lubricating a 2-stroke marine diesel engine the amount of detergent or detergents (on an oil free basis i.e., an actives basis) may be 0 wt % to 40 wt %, or 2 wt % to 35 wt %, or 5 wt % to 30 wt % of the lubricating composition.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide derived from polyisobutylene with number average molecular weight in the range 350 to 5000, or 500 to 3000. Succinimide dispersants and their preparation are disclosed, for instance in U.S. Pat. No. 3,172,892 or U.S. Pat. No. 4,234,435. Succinimide dispersants are typically the imide formed from a polyamine, typically a poly(ethyleneamine).

In one embodiment the invention further includes at least one dispersant which is a polyisobutylene succinimide derived from a polyisobutylene with number average molecular weight in the range 350 to 5000, or 500 to 3000. The polyisobutylene succinimide may be used alone or in combination with other dispersants.

In one embodiment the invention further includes at least one dispersant derived from polyisobutylene succinic anhydride, an amine and zinc oxide to form a polyisobutylene succinimide complex with zinc. The polyisobutylene succinimide complex with zinc may be used alone or in combination.

Another class of ashless dispersant includes Mannich bases. Mannich dispersants are the reaction products of alkylphenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant or dispersants may be present (on an oil free basis i.e., an actives basis) at 0 wt % to 20 wt %, or 0.1 wt % to 15 wt %, or 0.1 wt % to 10 wt %, or 1 wt % to 6 wt % of the lubricating composition.

Antioxidants

Antioxidant compounds are known and include for example, sulphurised olefins, alkylated diphenylamines (typically di-nonyl diphenylamine, octyl diphenylamine, di-octyl diphenylamine), hindered phenols, molybdenum compounds (such as molybdenum dithiocarbamates), or mixtures thereof. Antioxidant compounds may be used alone or in combination. The antioxidant or antioxidants may be present in ranges (on an oil free basis i.e., an actives basis) of 0 wt % to 20 wt %, or 0.1 wt % to 10 wt %, or 0.5 or 1 wt % to 5 wt %, of the lubricating composition.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the lubricating composition further includes a molybdenum compound.

The molybdenum compound is selected from the group consisting of molybdenum dialkyldithiophosphates, molybdenum dithiocarbamates, amine salts of molybdenum compounds, and mixtures thereof.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 S-515, and S-600 from Asahi Denka Kogyo K. K and mixtures thereof.

When present, the molybdenum compound may provide 5 ppm to 300 ppm, or 20 ppm to 250 ppm of molybdenum to the lubricating composition.

Viscosity Modifiers

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl arene conjugated diene copolymers, polyolefins, esters of maleic anhydride-styrene copolymers.

Dispersant Viscosity Modifiers

Dispersant viscosity modifiers (often referred to as DVM), include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine.

Antiwear Agents

In one embodiment the lubricating composition further includes at least one other antiwear agent other than the compound described herein above.

The additional antiwear agent may be either ashless or ash-forming. Typically ashless antiwear agents do not contain metal, whereas ash-forming do contain metal.

The antiwear agent may be present (on an oil free basis i.e., an actives basis) in ranges including 0 wt % to 15 wt %, or 0 wt % to 10 wt %, or 0.05 wt % to 5 wt %, or 0.1 wt % to 3 wt % of the lubricating composition.

In one embodiment the lubricating composition further includes a phosphorus-containing antiwear agent. Typically the phosphorus-containing antiwear agent may be present in an amount to deliver the ranges of phosphorus described below in the subject matter under the sub-heading "Industrial Application".

Examples of suitable antiwear agents include phosphate esters, sulphurised olefins, sulphur-containing anti-wear additives including metal dihydrocarbyldithiophosphates (such as primary or secondary zinc dialkyldithiophosphates, or molybdenum dialkyldithiophosphates), molybdenum thiocarbamate-containing compounds including thiocarbamate esters, alkylene-coupled thiocarbamates, and bis(S-alkyldithiocarbamyl)disulphides.

Examples of some suitable zinc dialkyldithiophosphate, among others, include those disclosed in PCT Application US07/073428, now WO 2008/011339 (entitled "Method of Lubricating an Internal Combustion Engine and Improving the Efficiency of the Emissions Control System of the Engine") or in PCT Application US07/073426, now WO 2008/011338 (entitled "Lubricating Oil Composition and Method of Improving Efficiency of Emissions Control System"). Both applications claim priority from Jul. 17, 2006. Certain zinc dialkyldithiophosphates may be defined as a zinc salt of a mixture of phosphorus-containing compounds represented by the formula:

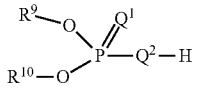

wherein in formula, $Q^1$ and $Q^2$ are independently S or O, and $R^9$ and $R^{10}$ may be independently hydrocarbyl groups, the average total number of carbon atoms in $R^9$ plus $R^{10}$ for the mixture of phosphorus-containing compounds being at least 9.5; wherein $R^9$ and $R^{10}$ are characterised in that (i) 4 to 70 weight percent of such groups contain 2 to 4 carbon atoms and (ii) 30 to 96 weight percent such groups contain 5 to 12 carbon atoms; and wherein, in less than 8 mole percent of the molecules of the formula in the mixture of phosphorus-containing compounds, each of $R^9$ and $R^{10}$ contain 2 to 4 carbon atoms and in greater than 11 mole percent of the molecules of the formula in said mixture $R^9$ has 2 to 4 carbon atoms and $R^{10}$ has 5 to 12 carbon atoms; and wherein, within the formula, the average total number of hydrogen atoms in $R^9$ and $R^{10}$ on carbon atoms located beta to the O atoms is at least 7.25. In other embodiments, the number of β hydrogens may be less than 7.25, e.g., 2 or 4 to 7.25; and in other embodiments the total number of carbon atoms in $R^9$ plus $R^{10}$ may be less than 9.5.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form the sulphurised olefin include propylene, butylene, isobutylene, pentene, hexane, heptene, octane, nonene, decene, undecene, dodecene, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as butylacrylate.

Another class of sulphurised olefin includes fatty acids and their esters. The fatty acids are often obtained from vegetable oil or animal oil and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids, including, for example, the amine salts of the phosphorylated or non-phosphorylated reaction product of a dialkyldithiophosphoric acid with propylene oxide; and mixtures thereof.

Friction Modifiers

In one embodiment the further includes a friction modifier, or mixtures thereof. Typically the friction modifier or friction modifiers may be present (on an oil free basis i.e., an actives basis) in ranges including 0 wt % to 10 wt %, or 0.05 wt % to 8 wt %, or 0.1 wt % to 4 wt %.

Examples of suitable friction modifiers include long chain fatty acid derivatives of amines, esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid (all these friction modifiers may also be antioxidants or antiwear agents).

In one embodiment the friction modifier friction modifier is selected from the group consisting of long chain fatty acid derivatives of amines, esters, or epoxides; fatty alkyl tartrates; fatty alkyl tartrimides; and fatty alkyl tartramides.

In one embodiment the friction modifier may be a long chain fatty acid ester (previously described above as an ashless antiwear agent). In another embodiment the long chain fatty acid ester may be a mono-ester and in another embodiment the long chain fatty acid ester may be a (tri)glyceride.

Other Additives

Other performance additives such as corrosion inhibitors include those described in paragraphs 5 to 8 of US Application US05/038,319, now WO 2006/047486 (filed on Oct. 25, 2004 McAtee and Boyer as named inventors), octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxidepropylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexyl acrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

Industrial Application

In one embodiment the mechanical device is an internal combustion engine.

In one embodiment the internal combustion engine may be a diesel fueled engine, a gasoline fueled engine, a natural gas fueled engine or a mixed gasoline/alcohol fueled engine. In one embodiment the internal combustion engine may be a diesel fueled engine and in another embodiment a gasoline fueled engine.

The internal combustion engine may be a 2-stroke or 4-stroke engine. Suitable internal combustion engines include marine diesel engines, aviation piston engines, low-load diesel engines, and automobile and truck engines.

As used herein the components of the internal combustion engine include all of the parts of the engine derived from metal lubricated by an engine lubricant. This includes for example, cylinder liners, camshafts, piston heads etc.

In one embodiment the internal combustion engine contains components ferric components. The ferric components include iron, steel, FeO, $Fe_3O_4$ or other materials containing iron.

In one embodiment the internal combustion engine contains components of an aluminium-alloy. The aluminium-alloy includes aluminium silicates, aluminium oxides, or other ceramic materials. In one embodiment the aluminium-alloy is an aluminium-silicate surface.

The lubricating composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less. In one embodiment the sulphated ash content may be 0.05 wt % to 0.9 wt %, or 0.1 wt % to 0.2 wt % to 0.45 wt %.

In one embodiment the lubricating composition is an engine oil, wherein the lubricating composition may be characterised as having (i) a sulphur content of 0.5 wt % or less, (ii) a phosphorus content of 0.07 wt % or less, and (iii) a sulphated ash content of 1.5 wt % or less.

In one embodiment the lubricating composition may be suitable for a 2-stroke or a 4-stroke marine diesel internal combustion engine. In one embodiment the marine diesel combustion engine is a 2-stroke engine.

The following examples provide illustrations of the invention. These examples are non-exhaustive and are not intended to limit the scope of the invention.

EXAMPLES

Example 1 (EX1) is a reaction product of:

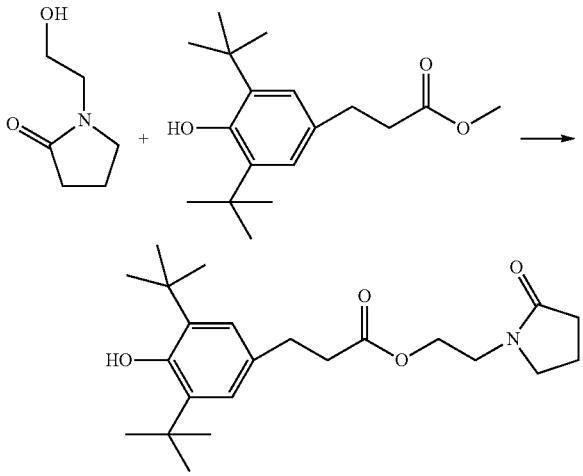

The reaction is carried out in a tared one-liter flask charged with the phenolic compound and the lactam. The flask is equipped with a thermocouple, stirrer, a sub-surface nitrogen inlet and a Dean Stark trap with water condenser. The flask is heated to 80° C. and an aluminium catalyst is added. The flask is heated with stirring in 30° C. increments to 180° C. The flask is held at temperature for 6 hours. The flask is cooled to ambient temperature. The sample obtained is analysed and the product is shown in the reaction scheme above. Infra-red analysis also indicates the formation of methanol byproduct.

Example 2 (EX2) is a reaction product of:

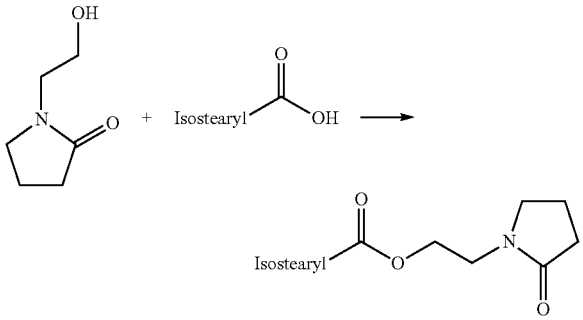

The reaction is carried out in a flask similar to EX1. The reaction is carried out at 185° C. for 10 hours before cooling to ambient temperature. Analysis also indicates formation of water byproduct.

Example 3 (EX3) is a reaction product of:

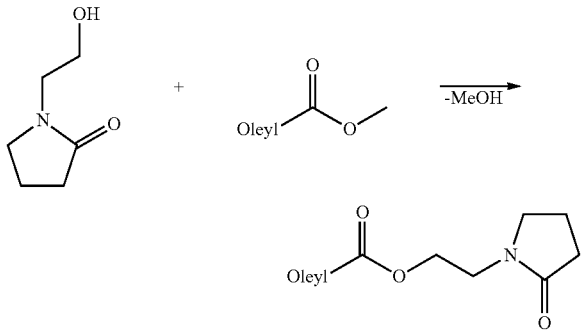

The reaction is carried out in a flask similar to EX1. The reaction is carried out at 140° C. for 7 hours, followed by heating to 160° C. holding for another 8 hours. Analysis of the product formed indicates presence of methanol byproduct and the product shown in the reaction scheme.

Example 4 (EX4) is a reaction product of:

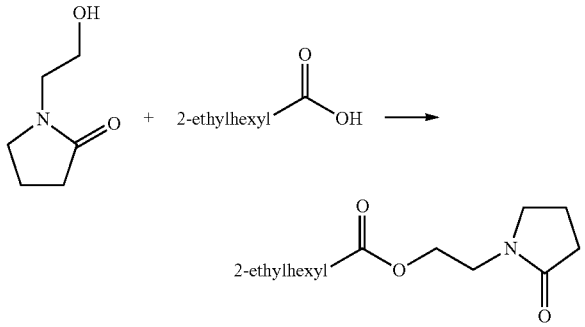

The reaction is carried out in a flask similar to EX1. The reaction employs 1.5 g of sulphonic acid catalyst that is added at 80° C. The flask is then heated to 140° C. for 4 hours. Thereafter the flask is heated to 160° C. for 1 hour. A potassium compound is added at 170° C. and the flask is held at temperature for 10 hours.

Example 5 (EX5) is a reaction product of:

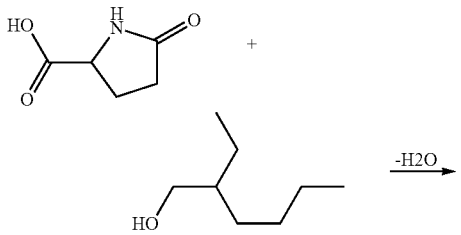

-continued

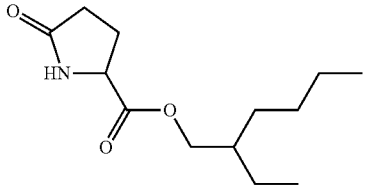

The flask is similar to EX1. The flask is heated to 130° C. and held for 7 hours. The flask is then heated to 140° C. and held for 8 hours. The flask is then stripped at 933 Pascals (or 7 Torr) for 3 hours at 150° C. to remove excess alcohol and water. The reaction yields 22 g of product.

Example 6 (EX6) is a reaction product of:

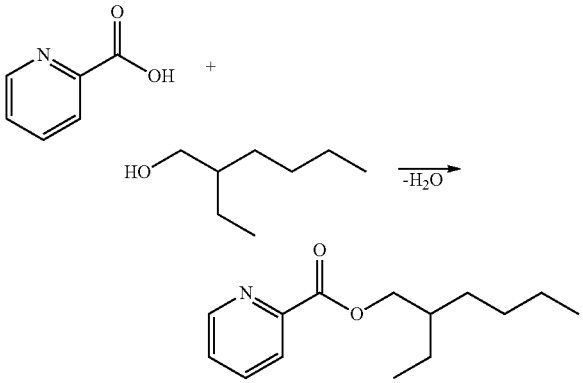

The flask is similar to that of EX1. The flask is heated to 150° C. and held for 16 hours. The flask is then cooled to 120° C. and vacuum stripped at about 600 Pascals (or about 6 Torr) for 3 hours. The reaction yields 25.3 g of product.

Example 7 (EX7) is a reaction product of:

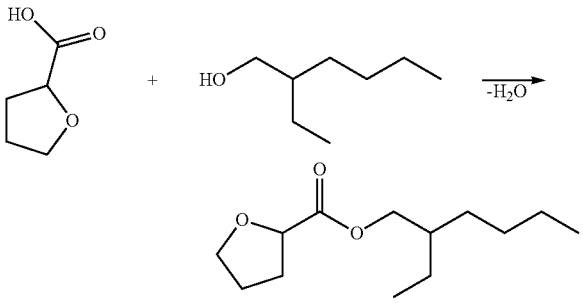

The flask is similar to that used in EX1. The flask is heated to 130° C. for 3 hours followed by heating to 140° C. for 4 hours. The flask is then heated to 145° C. and held for 13 hours. The product formed is vacuum stripped at about 600 Pascals (or about 6 Torr) for 3 hours. The reaction yields 28 g of product.

Example 8 (EX8) is a reaction product of:

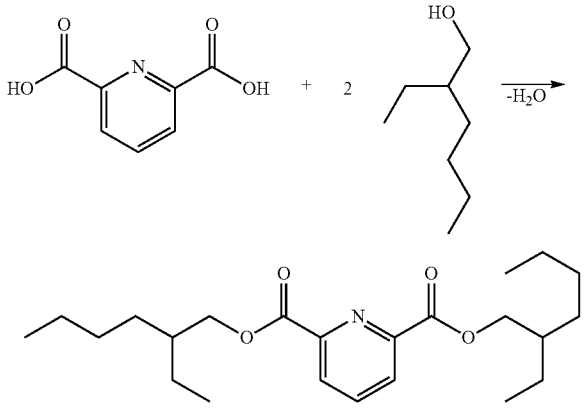

The flask is similar to EX1. The flask is heated to 130° C. for 6 hours before heating to 140° C. The flask is held at 140° C. for 8 hours. The resultant product is vacuum stripped at about 600 Pascals (or about 6 Torr) for 3 hours at 120° C. The reaction yields 39.1 g of product.

Example 9 (EX9) is a reaction product of:

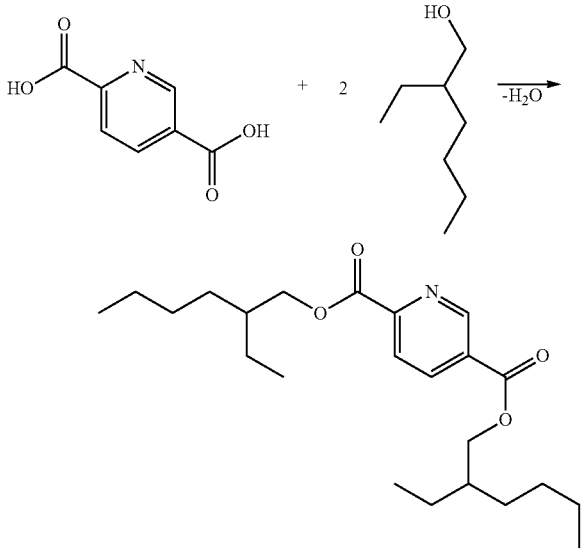

The flask is the same as EX1. The flask is heated to 130° C. and held for 6 hours. The flask is then heated to 150° C. and held for 8 hours. The flask is then heated to 160° C. and held for 8 hours. The reaction yields 27 g of product.

Example 10 (EX10) is a reaction product of:

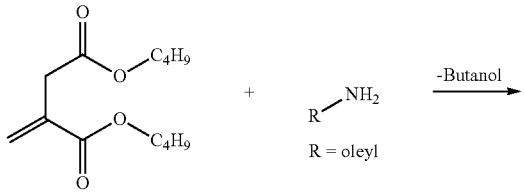

-continued

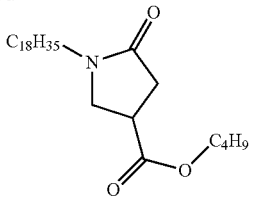

The flask is the same as EX1. The flask is heated to 165° C. and held for 16 hours. The flask is then cooled to 130° C. and vacuum stripped at about 600 Pascals (or about 6 Torr) for 3 hours.

Example 11 (EX11) is a reaction product of:

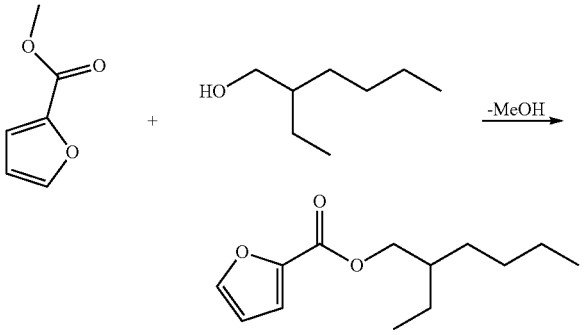

The flask is the same as EX1. The flask is charged with a titanium catalyst and heated to 140° C. and held for 4 hours. The flask is then cooled to 135° C. and held for 13 hours. The flask is then cooled to 110° C. and vacuum stripped at about 600 Pascals (or about 6 Torr) for 3 hours. The reaction yields 28 g of product.

Example 12 (EX12): Preparation of Imidazoline. The imidazoline is prepared from a condensation of a mixture of fatty acids with 16 to 18 carbon atoms with tetraethylene pentamine. The resultant product contains a mixture of imidazolines and linear alkyl amides.

Example 13 (EX13): Preparation of an Oxazoline. The oxazoline is prepared by the reaction of isostearic acid with tris-hydroxymethylaminomethane.

Example 14 (EX14): Preparation of a tetrahydropyrimidine. The tetrahydropyrimidine is prepared by the reaction of a 1,3-diamine with isostearic acid.

Example 15 (EX15): Preparation of a tetrahydropyrimidine. The tetrahydropyrimidine is prepared by the reaction of a 1,3-diamine with an alkyl succinic acid or anhydride.

Example 16 (EX16): reaction product of (a) an ester derived from cyanoacetic acid reacted with a $C_{8-10}$-alcohol mixture (Alfol™810), (b) formaldehyde and (c) tolyltriazole (mole ratio 1:1.1:1). A one liter 4-necked round bottom flask equipped with a mechanical stirrer, nitrogen inlet, Dean-Stark apparatus, Friedrichs condenser and thermowell is charged with 72 g of formaldehyde, 107 g of tolyltriazole and 171 g of the ester derived from cyanoacetic acid reacted with a $C_{8-10}$-alcohol mixture. 151 g of toluene, 10 drops of acetic acid catalyst, and 10 drops of piperidine catalyst are added. The flask is heated to 120° C. and held for 8 hours. 55.7 g of water is obtained. The flask is then heated to 130° C. and held for 4 hours. The Dean-stark apparatus is replaced with a dry-ice cooled receiving flask. Toluene solvent is removed under vacuum (<3 kPa, <20 mm Hg) at 130° C. for 3 hours. The product is cooled and jarred.

Example 17 (EX17): reaction product of (a) an ester of malonic acid and a $C_{8-10}$-alcohol mixture (Alfol™810), (b) formaldehyde and (c) tolyltriazole (mole ratio 1:1.1:1). A one liter 4-necked round bottom flask equipped with a mechanical stirrer, nitrogen inlet, Dean-Stark apparatus, Friedrichs condenser and thermowell is charged with the 2.33 g of formaldehyde, 104 g of tolyltriazole and 249 g of ester of malonic acid and a $C_{8-10}$-alcohol. 182 g of toluene and 10 drops of acetic acid catalyst and 10 drops of piperidine catalyst are added. The flask is heated to 90° C. and held for 8 hours. The flask is then heated to 110° C. and held for 8 hours to remove water azeotropically. The flask is then heated to 120° C. and held for 3 hours. Solvent is then removed by vacuum (<3 kPa, <20 mm Hg) at 120° C. for 3 hours. An orange liquid is obtained that upon cooling forms a low melting solid.

Example 18 (EX18): reaction product of (a) a ketoester (derived from a mole equivalent reaction of ethylacetate and a $C_{8-10}$-alcohol mixture (Alfol™810)), (b) formaldehyde and (c) tolyltriazole (mole ratio 1:1.1:1). A one liter 4-necked round bottom flask equipped with a mechanical stirrer, nitrogen inlet, Dean-Stark apparatus, Friedrichs condenser and thermowell is charged with 68.5 g of formaldehyde, 102 g of tolyltriazole and 177.4 g of ketoester. 150 g of toluene and 10 drops of acetic acid catalyst and 10 drops of piperidine catalyst are added. The flask is then heated to 110° C. and held for 8 hours to remove water azeotropically. 54.0 g of water is obtained. The flask is then heated to 130° C. and held for 6 hours. Solvent is then removed by vacuum (<3 kPa, <20 mm Hg) at 130° C. for 3 hours. After cooling a dark brown liquid is obtained.

Lubricating Compositions

Lubricating compositions suitable for 4-stroke internal combustion engines are prepared by blending the additives shown in tables 1 to 5 with base oil.

TABLE 1

| | | Treat Rate (wt %, except ZDDP quoted on ppm of Phosphorus) | | | | | |
|---|---|---|---|---|---|---|---|
| | | Lubricant | | | | | |
| | | 1 | 2 | 3 | 4 | 5 | 6 |
| Viscosity Modifiers | OCP[1] | 8 | | | 8 | | |
| | OCP[2] | | 8 | | | 8 | |
| | SB | | | 8 | | | 8 |
| Succinimide Dispersants | 15 TBN | 5 | 5 | 5 | 5 | 5 | 5 |
| | 30 TBN | | | | | | |
| ZDDP | Primary | | | | 500 | 500 | 500 |
| | Secondary | 500 | 500 | 500 | | | |
| Overbased Detergents | Ca sulphonate | 1.5 | 1.5 | 1.5 | 1.5 | 1.5 | 1.5 |
| | Ca phenate | | | | | | |
| Antioxidants | Phenolic | 2 | 2 | 2 | 2 | 2 | 2 |
| | Aminic | 1 | 1 | 1 | 1 | 1 | 1 |

Footnote

OCP[1] is a high SSI (may also be referred to as a shear stability index) ethylene-propylene copolymer, including conventional diluent oil OCP[2] is a low SSI ethylene-propylene copolymer, including diluent oil SB is a hydrogenated styrene butadiene copolymer, including diluent oil ZDDP is zinc dialkyl dithiophosphate Ca is calcium Aminic is a mixture of nonyldiphenylamine and di-nonyldiphenylamine Phenolic is a hindered phenol antioxidant as described in the detailed description The amount of dispersant shown in Table 1 (and in the following tables) includes about 45 wt % of diluent oil The amount of overbased detergents shown in Table 1 (and in the following tables) includes 40 wt % of diluent oil.

TABLE 2

| | | Treat Rate (wt %, except ZDDP quoted on ppm of Phosphorus) | | | | | |
|---|---|---|---|---|---|---|---|
| | | Lubricant | | | | | |
| | | 7 | 8 | 9 | 10 | 11 | 12 |
| Viscosity Modifiers | OCP[1] | 8 | | | 8 | | |
| | OCP[2] | | 8 | | | 8 | |
| | SB | | | 8 | | | 8 |
| Succinimide Dispersants | 15 TBN | 5 | 5 | 5 | 5 | 5 | 5 |
| | 30 TBN | | | | | | |
| ZDDP | Primary | | | | 700 | 700 | 700 |
| | Secondary | 700 | 700 | 700 | | | |
| Overbased Detergents | Ca sulphonate | 1.5 | 1.5 | 1.5 | 1.5 | 1.5 | 1.5 |
| | Ca phenate | | | | | | |
| Antioxidants | Phenolic | 2 | 2 | 2 | 2 | 2 | 2 |
| | Aminic | 1 | 1 | 1 | 1 | 1 | 1 |

TABLE 3

| | | Treat Rate (wt %, except ZDDP quoted on ppm of Phosphorus) | | | | | |
|---|---|---|---|---|---|---|---|
| | | Lubricant | | | | | |
| | | 13 | 14 | 15 | 16 | 17 | 18 |
| Viscosity Modifiers | OCP[1] | 8 | | | 8 | | |
| | OCP[2] | | 8 | | | 8 | |
| | SB | | | 8 | | | 8 |
| Succinimide Dispersants | 15 TBN | | | | | | |
| | 30 TBN | 7 | 7 | 7 | 7 | 7 | 7 |
| ZDDP | Primary | | | | 800 | 800 | 800 |
| | Secondary | 800 | 800 | 800 | | | |
| Overbased Detergents | Ca sulphonate | | | | | | |
| | Ca phenate | 1.5 | 1.5 | 1.5 | 1.5 | 1.5 | 1.5 |
| Antioxidants | Phenolic | 3 | 3 | 3 | 3 | 3 | 3 |
| | Aminic | 1 | 1 | 1 | 1 | 1 | 1 |

TABLE 4

| | | Treat Rate (wt %, except ZDDP quoted on ppm of Phosphorus) | | | | | |
|---|---|---|---|---|---|---|---|
| | | Lubricant | | | | | |
| | | 19 | 20 | 21 | 22 | 23 | 24 |
| Viscosity Modifiers | OCP[1] | 8 | | | 8 | | |
| | OCP[2] | | 8 | | | 8 | |
| | SB | | | 8 | | | 8 |
| Succinimide Dispersants | 15 TBN | | | | | | |
| | 30 TBN | 7 | 7 | 7 | 7 | 7 | 7 |
| ZDDP | Primary | | | | 1000 | 1000 | 1000 |
| | Secondary | 1000 | 1000 | 1000 | | | |
| Overbased Detergents | Ca sulphonate | | | | | | |
| | Ca phenate | 1.5 | 1.5 | 1.5 | 1.5 | 1.5 | 1.5 |
| Antioxidants | Phenolic | 3 | 3 | 3 | 3 | 3 | 3 |
| | Aminic | 1 | 1 | 1 | 1 | 1 | 1 |

TABLE 5

| | | Treat Rate (wt %, except ZDDP quoted on ppm of Phosphorus) | | | | | |
|---|---|---|---|---|---|---|---|
| | | Lubricant | | | | | |
| | | 25 | 26 | 27 | 28 | 29 | 30 |
| Viscosity Modifiers | OCP[1] | 8 | | | 8 | | |
| | OCP[2] | | 8 | | | 8 | |
| | SB | | | 8 | | | 8 |
| Succinimide Dispersants | 15 TBN | | | | | | |
| | 30 TBN | 7 | 7 | 7 | 7 | 7 | 7 |
| ZDDP | Primary | | | | 1200 | 1200 | 1200 |
| | Secondary | 1200 | 1200 | 1200 | | | |
| Overbased Detergents | Ca sulphonate | | | | | | |
| | Ca phenate | 1.5 | 1.5 | 1.5 | 1.5 | 1.5 | 1.5 |
| Antioxidants | Phenolic | 3 | 3 | 3 | 3 | 3 | 3 |
| | Aminic | 1 | 1 | 1 | 1 | 1 | 1 |

Lubricating composition 31 is a 2-stroke marine diesel cylinder lubricant containing 2 wt % of 30 TBN succinimide dispersant, 8 wt % calcium sulphonate, 15 wt % of calcium phenate and balance base oil.

The lubricating compositions 1 to 31 are then treated with 1 wt % of each antiwear heterocyclic compound prepared above to create lubricating compositions containing the compounds of the invention.

Lubricating compositions LC1 to LC15 are derived from lubricant 1 (see Table 1) containing 1 wt % of the product of examples 1 (EX1) to 15 (EX15) respectively.

Lubricating compositions LC16 to LC30 are derived from lubricant 2 (see Table 1) containing 1 wt % of the product of examples 1 (EX1) to 15 (EX15) respectively.

Lubricants 3 to 30 (from Tables 1 to 5) are treated with containing 1 wt % of the product of examples 1 (EX1) to 15 (EX15) respectively to form LC31 to LC450.

Lubricating compositions LC451 to LC465 are derived from lubricant 31 containing 1 wt % of the product of examples 1 (EX1) to 15 (EX15) respectively.

Lubricant 32 is a SAE 5W-30 engine oil formulation containing, among other components, 570 ppm of phosphorus derived from zinc dialkyldithiophosphate, 7.9 wt % of succinimide dispersants (including about 31 wt % of diluent oil), 1.48 wt % of a mixture of calcium sulphonate overbased detergent, calcium phenate overbased detergent and calcium salicylate overbased detergent (total detergents containing about 42 wt % of diluent oil), 0.5 wt % of a mixture of aminic antioxidants (typically composed of nonyldiphenylamine and dinonyldiphenylamine), and 3.0 wt % of a hindered phenol antioxidant as described in the detailed description.

Lubricating compositions LC466 to 468 are the same as lubricant 32, except LC466 contains 1 wt % of the product of EX16, LC467 contains 1 wt % of the product of EX17, and LC468 contains 1 wt % of the product of EX18.

Comparative Example 1 (CE1) is a lubricant the same as LC1, except no heterocyclic antiwear agent is present.

Comparative Example 2 (CE2) is a lubricant the same as lubricant 32, except no heterocyclic antiwear agent is present.

Test 1: Cameron Plint Wear Test

The Cameron Plint TE-77™ is a reciprocating wear tester. In this test a steel ball upper specimen is reciprocated against a steel flat lower specimen. The Cameron Plint is charged with 10 ml of sample and heated to 50° C. and held for 1 minute. The sample is then subject to a load of 100N over two minutes while at the same time the reciprocation is started at 10 Hz over 15 mm stroke length. The sample is then heated to 250° C. at 3° C. per minute. At the end of the test the average diameter of the wear scar (in micrometers) on the ball (measured in the X and Y directions) is measured using a calibrated microscope. The results obtained are as follows.

TABLE 6

| Example | Wear Scar (micrometres) | Film Thickness (%) | Friction Coefficient |
|---|---|---|---|
| CE1 | 924 | 27.1 | 0.159 |
| LC1 | 273 | 91.8 | 0.0093 |
| LC2 | 696 | 37.3 | 0.145 |
| LC3 | 572 | 70 | 0.1728 |
| LC4 | 654 | 49 | 0.1299 |
| LC5 | 332 | 78.2 | 0.0958 |
| LC6 | 335 | 81 | 0.1131 |
| LC7 | 353 | 70.8 | 0.1253 |
| LC8 | 331 | 81.1 | 0.1138 |
| LC9 | 347 | 84.7 | 0.1022 |

TABLE 6-continued

| Example | Wear Scar (micrometres) | Film Thickness (%) | Friction Coefficient |
|---|---|---|---|
| LC10 | 587 | 70.7 | 0.1211 |
| LC11 | 532 | 66.8 | 0.1284 |

Footnote:
The results reported in Table 6 relate to wear scars obtained for a ferric engine component.

Similar trends may be observed for the remaining lubricating compositions.

Test 2: HFFR Wear

Examples LC12 to LC15 and CE1 are evaluated for wear performance in a programmed temperature high frequency reciprocating rig (HFRR) available from PCS Instruments. HFRR conditions for the evaluations were 500 g load, 75 minute duration, 1000 micrometer stroke, 20 hertz frequency, and temperature profile of 15 minutes at 40° C. followed by an increase in temperature to 160° C. at a rate of 2° C. per minute. Wear scar in micrometers and film formation as percent film thickness are then measured with lower wear scar values and higher film formation values indicating improved wear performance. The percent film thickness is based on the measurement of electrical potential between an upper and a lower metal test plate in the HFRR. When the film thickness is 100%, there is a high electrical potential for the full length of the 1000 micrometer stroke, suggesting no metal to metal contact. Conversely for a film thickness of 0% there is no electrical potential suggesting continual metal to metal contact between the plates. For intermediate film thicknesses, there is an electrical potential suggesting the upper and lower metal test plate have a degree of metal to metal contact as well as other areas with no metal to metal contact. The wear scar and film formation results obtained are presented in Table 7.

TABLE 7

| Example | Ball Wear Scar (micrometres) | Wear Scar on Engine Component | Friction Coefficient |
|---|---|---|---|
| CE1 | 223 | 268 | 0.120 |
| LC12 | 202 | 202 | 0.115 |
| LC13 | 205 | 205 | 0.113 |

Footnote:
Wear Scar on Engine Component - is an engine component made from aluminium silicate.

Lubricant CE2 and LC466 to LC468 are evaluated in a HFRR by the same methodology of Test 2. the results obtained are:

| Example | Wear Scar on Engine Component | Friction Coefficient |
|---|---|---|
| CE2 | 394 | 0.207 |
| LC466 | 278 | 0.145 |
| LC467 | 313 | 0.173 |
| LC468 | 305 | 0.166 |

Overall the results obtained for the heterocyclic compounds of the present invention indicate that the compounds have antiwear and/or extreme pressure performance in a lubricating composition.

The trends above apply to engines containing components with ferric and/or aluminium surfaces lubricated by an engine oil.

It is known that some of the materials described above may interact in the final formulation, so that the components of the final formulation may be different from those that are initially added. The products formed thereby, including the products formed upon employing lubricating composition of the present invention in its intended use, may not be susceptible of easy description. Nevertheless, all such modifications and reaction products are included within the scope of the present invention; the present invention encompasses lubricating composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements. Multiple groups represented by the same symbol in the formulae described above, may be the same or different.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms, and encompass substituents as pyridyl, furyl, thienyl and imidazolyl; and (iv) heteroatoms, including sulphur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for lubricating an internal combustion engine comprising supplying to the internal combustion engine a lubricating composition comprising an oil of lubricating viscosity and 0.2 to 5 wt % of a heterocycle having a hydrocarbyl group containing 6 to 40 carbon atoms, wherein the heterocycle compound has a functional group selected from the group consisting of at least one of an ester, an amide, a salt and an acid, and is represented by the formulae:

wherein the heterocycle is an aromatic compound represented by the formula:

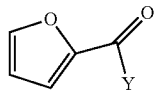

wherein, independently, each variable

Y is —O—$R^4$; and $R^4$ is a hydrocarbyl group containing 6 to 40 carbon atoms, wherein the internal combustion engine contains lubricated ferric components.

2. The method of claim 1, wherein the hydrocarbyl group containing 6 to 40 carbon atoms is a linear or branched alkyl group.

3. The method of claim 1, wherein the oil of lubricating viscosity comprises an API Group I, Group II, Group III, Group IV oil, or mixtures thereof.

* * * * *